US007604337B2

(12) United States Patent
Koseki

(10) Patent No.: US 7,604,337 B2
(45) Date of Patent: Oct. 20, 2009

(54) INKJET HEAD AND INKJET RECORDING DEVICE

(75) Inventor: Osamu Koseki, Chiba (JP)

(73) Assignee: SII Printek Inc. (JP)

( * ) Notice: Subject to any disclaimer, the term of this patent is extended or adjusted under 35 U.S.C. 154(b) by 375 days.

(21) Appl. No.: 11/388,372

(22) Filed: Mar. 24, 2006

(65) Prior Publication Data

US 2007/0008384 A1 Jan. 11, 2007

(30) Foreign Application Priority Data

Jun. 23, 2005 (JP) ..... 2005-182850
Dec. 21, 2005 (JP) ..... 2005-367821

(51) Int. Cl.
*B41J 2/19* (2006.01)

(52) U.S. Cl. ..... 347/92

(58) Field of Classification Search ..... None
See application file for complete search history.

(56) References Cited

U.S. PATENT DOCUMENTS 4,187,512 A * 2/1980 Matsunaga et al. ..... 347/85
4,340,895 A * 7/1982 Kikuchi ..... 347/92
4,575,738 A 3/1986 Sheufelt et al.
5,489,925 A * 2/1996 Brooks et al. ..... 347/6
5,847,734 A * 12/1998 Pawlowski, Jr. ..... 347/86
5,936,650 A 8/1999 Ouchida et al.
6,036,305 A * 3/2000 Nagasaki et al. ..... 347/86
6,634,738 B1 * 10/2003 Shinada et al. ..... 347/86
2001/0013884 A1 * 8/2001 Crystal et al. ..... 347/85
2002/0057320 A1 * 5/2002 Kaga et al. ..... 347/92
2003/0048337 A1 * 3/2003 Jones et al. ..... 347/86
2003/0234845 A1 * 12/2003 Tominaga et al. ..... 347/92
2004/0196341 A1 * 10/2004 Ogura et al. ..... 347/86

FOREIGN PATENT DOCUMENTS

EP 0383558 A1 2/1990
EP 1574341 A1 9/2005
JP 2004/249571 A 9/2004

* cited by examiner

*Primary Examiner*—Stephen D Meier
*Assistant Examiner*—Alexander C Witkowski
(74) *Attorney, Agent, or Firm*—Adams & Wilks

(57) ABSTRACT

An inkjet head capable of achieving stable ejection of ink by preventing air bubbles from being left in the upstream side of a nozzle of a filter element such as mesh filter that is provided in an inkjet head owing to the efficient use of the open area of the filter element. The inkjet head is provided to have a fluid channel communicated with the atmosphere from the upstream side region of the filter element such as mesh filter, with regard to the nozzle without passing through the filter element and the nozzle.

20 Claims, 8 Drawing Sheets

INKJET HEAD AND INKJET RECORDING DEVICE

BACKGROUND OF THE INVENTION

1. Field of the Invention

The present invention relates to an inkjet head adapted for use in an inkjet printer, which ejects ink droplets and records by printing various images on a target-recording medium.

2. Description of the Related Art

Hitherto, an inkjet recording device is well known, which records by printing characters and images on a target recording medium by using an inkjet head having a plurality of nozzles, which eject ink. FIGS. 11, 12, and 13 are a perspective view, a schematic elevational view, and a schematic cross-sectional view, respectively, illustrating an example of such an inkjet head, and FIG. 14 is an exploded view illustrating an actuator section which generates pressure necessary for ink-ejection and a peripheral portion of the nozzles from which ink is finally ejected.

As shown in FIG. 14, a piezoelectric ceramic plate 1 has a plurality of channels 5 which are juxtaposed in parallel, and respective channels 5 are separated from one another by sidewalls 21.

One end section of each channel 5 is longitudinally extended to one edge face of the piezoelectric ceramic plate 1 while the other end section of the channel 5 does not extend to the other edge face of the plate, so that the channel depth becomes gradually shallower toward the other end section.

Moreover, electrodes 4 for applying a driving electric field are formed on the open-side faces of both sidewalls 21 for each channel 5 so as to extend along the longitudinal direction.

Furthermore, an ink chamber plate 2 constituting a common ink chamber 6, which communicating with the shallower end section of each channel 5 is connected to the piezoelectric ceramic plate 1 on the open sides of the channels 5 so as to form a head tip 26. A nozzle plate 3 is connected to the end face of a composite body consisting of the piezoelectric ceramic plate 1 and the ink chamber plate 2, where the channels 5 open up from the composite body and nozzle holes 11 are formed at positions of the nozzle plate 3 facing respective channels 5. The nozzle plate 3 and the head tip 26 are fixed by a head cap 12, and the electrodes 4 formed on the head tip 26 and a driving circuit board 14 are connected by a flexible board 19.

Moreover, an ink flow-channel member 40 to supply ink to the common ink chamber 6 is fixed to the ink chamber plate 2, an ink inlet port 41 for introducing ink is formed at the center of the flow-channel member 40, and a pressure relief unit 70 for absorbing any fluctuation in pressure during the printing operation is connected to the ink inlet port 41. Furthermore, since a filter 7 is fixed to the flow-channel member 40 so as to prevent foreign materials from flowing into and plugging the nozzle holes 11 and since the filter 7 partitions the flow-channel of the flow-channel member 40, the flow channel of the flow-channel member 40 is separated into an ink reservoir A 10 located on the upstream side of the nozzle holes 11 and an ink reservoir B 43 located on the downstream side of the nozzle holes 11. These parts and elements are eventually fixedly mounted on the base 13 made of an aluminum material.

In an inkjet head configured in this manner, when ink is filled in each of the channels 5 through the pressure release unit 70 and the flow-channel member 40 and when a predetermined driving electric field is applied to a predetermined channel 5 through the electrodes 4, the volume in a predetermined channel 5 changes due to the deformation of the sidewalls 21, resulting in ink in the predetermined channel 5 being ejected from the corresponding nozzle hole 11.

SUMMARY OF THE INVENTION

Nevertheless, in the case of the conventional inkjet head, air bubbles are trapped and stagnated in the ink reservoir A 10 which is located on the upstream side of the filter. For example, as shown in FIGS. 15 and 16, air bubbles 42*a* and 42*b* entrained with flowing ink through the ink inlet port 41 cannot flow by passing through the filter 7 and accordingly, remain at positions away from the ink inlet port 41. There is a problem then that when the air bubbles stagnate in such positions, an ink passage region of the filter 7 is reduced to a length Y compared with the original effective length X of the filter 7 and that the effective area of the filter filled with ink must become smaller, so that the supply of ink to the common ink chamber 6 becomes insufficient.

Specifically, for instance, when using ink such as water-based ink, etc. where the permeation of air bubbles is worse, it becomes easy to generate air bubbles and shortages in the supply of ink increase. Moreover, air bubbles remaining in such an ink reservoir A 10 are generally removed by performing a so-called cleaning operation, namely, sucking from the side of the nozzle holes 11 or pressurizing from the ink supply side. However, even if this cleaning operation is performed, there is a problem such that air bubbles stagnating in the ink reservoir A 10, that is, the upstream side of the filter 7, are difficult to be practically removed without passing through the filter 7.

Furthermore, specifically, in the case where droplet size of ink is large and the number of the nozzle openings is large, that is, when the amount of ink ejected per unit time is large, the amount of remaining air bubbles which exists in the ink reservoir becomes large, so that there is a problem that the area of the ink flow-channel becomes essentially narrow and the shortage in the supply of ink increases. It might be considered that the flow rate of ink is accelerated by making the flow-channel of the ink reservoir narrow. However, there is a problem that the size of the filter becomes smaller in practice and this becomes a reason for the shortage in the supply of ink to the common ink chamber.

Moreover, even when using such a technique, it is impossible to completely remove air bubbles remaining at the upstream side of the filter 7 in the ink reservoir A 10 by performing the above-mentioned cleaning operation.

By taking into account the above-mentioned facts, it is an object of the present invention to provide an inkjet head and an inkjet recording device which can prevent air bubbles in ink from remaining in an ink reservoir and inside of a head tip with certainty, and which can relatively easily remove air bubbles.

In order to solves the aforementioned problems, the present invention provides an inkjet head, which includes a plurality of channels juxtaposed in parallel to be communicated with nozzles, a common ink chamber which supplies ink to each of the channels, an ink flow-channel provided for being communicated with the common ink chamber, and a filter element provided in the ink channel configured by the common ink chamber and the ink flow-channel, wherein a fluid routing channel that communicates with the atmosphere from an area on the upstream-side of the nozzles without passing through the filter element and nozzles is provided in the region composed of the filter element consisting of the ink flow-channel and the filter element having a mesh filter therein and wherein the aforementioned fluid routing channel communicating with the atmosphere has a function to maintain a vacuum pressure in the ink channel configured by the aforementioned nozzles and the ink flow-channel.

As will be understood from the above explanation, since the present invention provides a fluid routing channel, which communicates with the atmosphere, not through a filter element and a nozzle from the area of an upstream side of the nozzle in the region composed of the ink flow-channel and the filter element such as the mesh filter, etc., air bubbles remaining at the upstream side of the filter element can be removed, and, moreover, since it has a function which maintains a vacuum pressure in the ink channel configured by the nozzle and the ink supply channel, stable printing can be performed.

DETAILED DESCRIPTION OF THE INVENTION

Hereinafter, the present invention will be described in detail referring to preferred embodiments of the present invention.

FIRST EMBODIMENT

Figure 1:
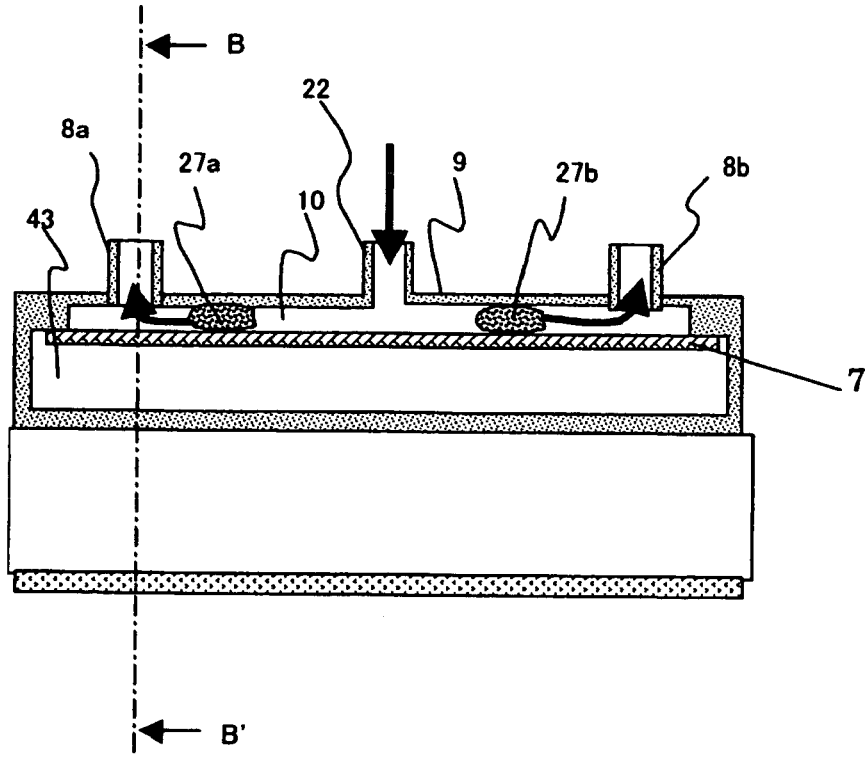
FIG. 1 is a schematic cross-sectional view, illustrating the main parts of an inkjet head of the first embodiment of the present invention.
Figure 2:
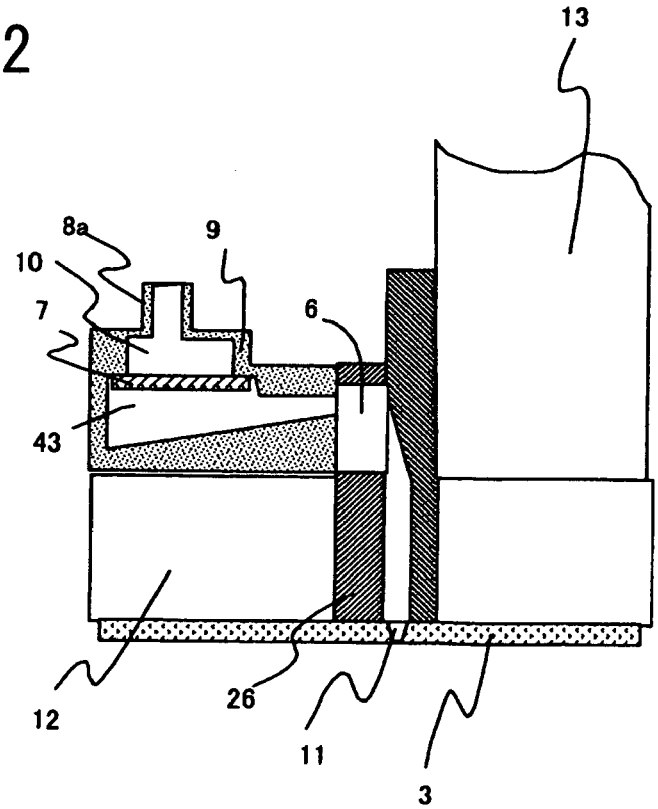
FIG. 2 is a cross-sectional view of the first embodiment of the present invention, when viewing from the arrows B-B' indicated in FIG. 1.
Figure 3:
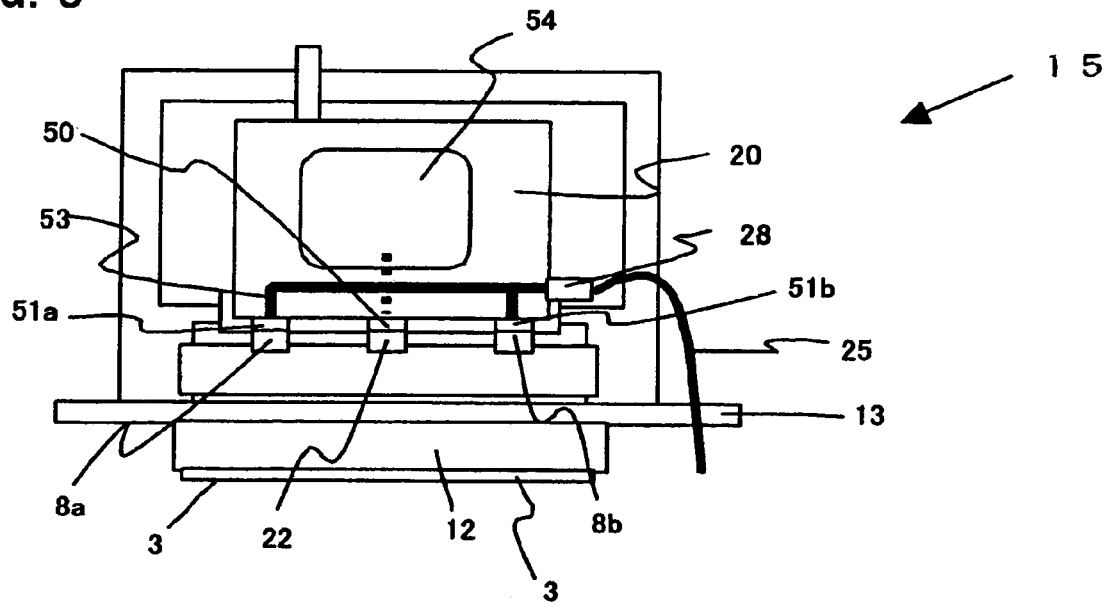
FIG. 3 is an elevational view, illustrating a whole inkjet head of the first embodiment of the present invention.
Figure 4:
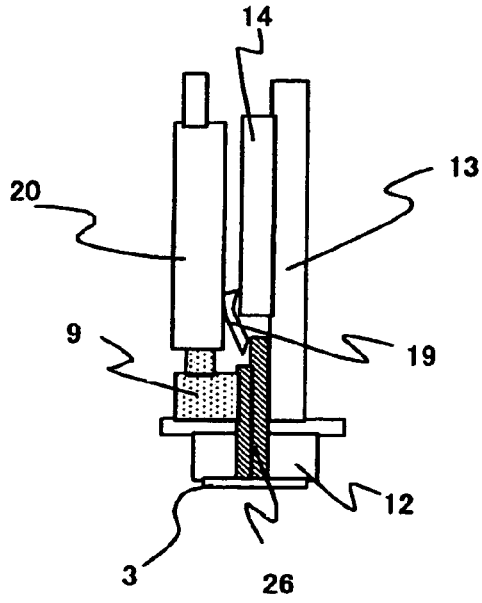
FIG. 4 is a schematic cross-sectional view, illustrating a whole inkjet head of the first embodiment of the present invention.
Figure 5:
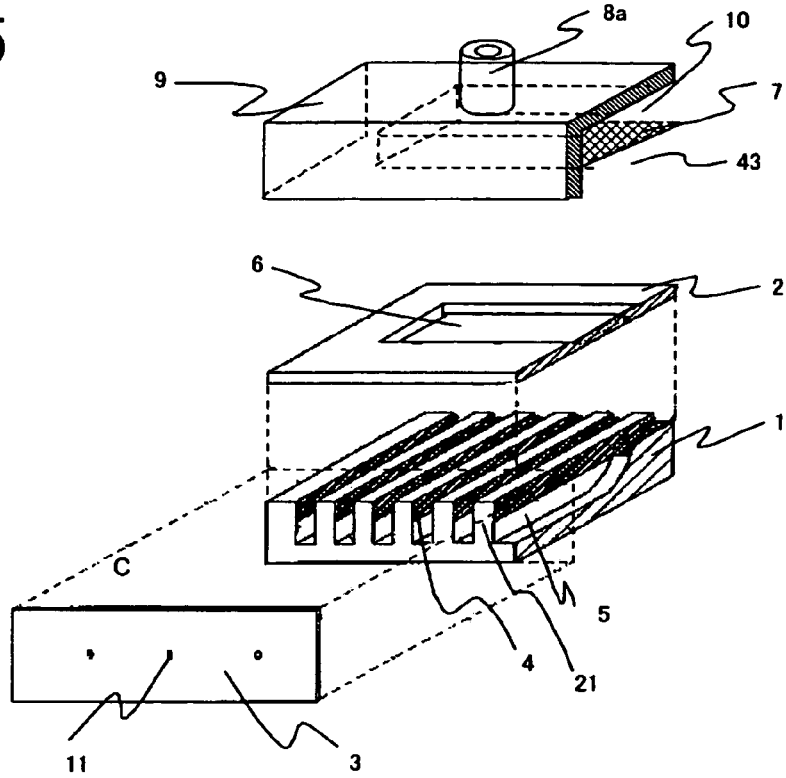
FIG. 5 is an exploded view, illustrating an area surrounding an ejection pressure generation section of an inkjet head of the first embodiment of the present invention.

FIG. 1 is a schematic cross-sectional view, illustrating the main important portion of an inkjet head of the first embodiment. FIG. 2 is a cross-sectional view taken at the position of arrows B-B' in FIG. 1 of the first embodiment, FIG. 3 an elevational view, illustrating a whole inkjet head of the first embodiment, FIG. 4 a schematic cross-sectional view, illustrating an inkjet head of the first embodiment, and FIG. 5 an exploded view, illustrating an area surrounding the section which generates the ejection pressure in an inkjet head of the first embodiment.

Figure 6:
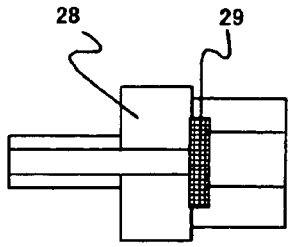
FIG. 6 is a schematic cross-sectional view, illustrating an bubble-removal joint used in an inkjet head of the first embodiment of the present invention.
Figure 17:
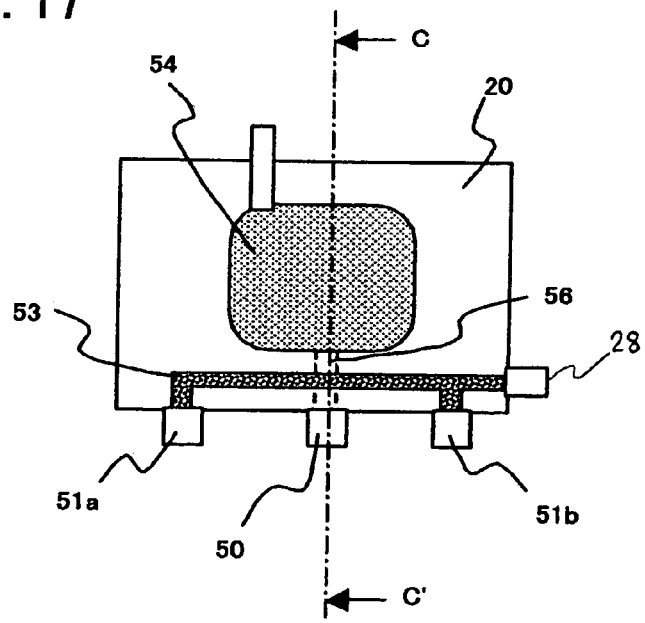
FIG. 17 is an elevational view, illustrating a pressure relief unit used in an inkjet head of the first embodiment of the present invention.
Figure 18:
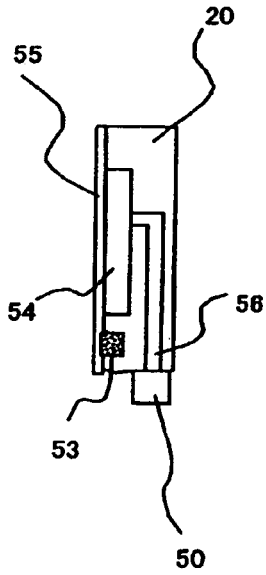
FIG. 18 is a cross-sectional view of a pressure releasing unit used in an inkjet head of the first embodiment of the present invention when viewing from the arrows C-C'.

As shown in the drawing figures, an inkjet head 15 of the first embodiment has a head tip 26, a flow-channel 9 as an ink flow-channel, which is provided on one face side thereof, a circuit board 14 on which a driving circuit, etc. is mounted in order to drive the head tip 26, and a pressure relief unit 20 to relieve a pressure change in the head tip 26, and each of these components is fixedly mounted on the base 13. As shown in FIGS. 17 and 18, in the pressure relief unit 20, a deformable film 55 connected to the body of the pressure relief unit 20 to define a recess-shape ink reservoir 54, a flow-channel joint 50 to deliver ink reserved in the ink reservoir 54 to the flow-channel 9, and air bubble return joints 51*a* and 51*b* arranged right and left with the center of the flow-channel joint 50 are provided, and these air bubble return joints 51*a* and 51*b* are connected to a bubble-removal channel 53 to purge the bubbles. At the tip of the bubble-removal channel 53, a bubble-removal joint 28 shown in FIG. 6 is provided and a vacuum pressure retaining unit (system) in the form of a filter 29 (second mesh filter) with a hole diameter of 25 micrometers is fixed inside of the bubble-removal joint 28. A tube 25 is connected to the bubble-removal joint 28 and the other end thereof is fixed to a carriage for fixing the inkjet head 15, resulting in a function for ejecting bubbles and ink. In this embodiment, the bubble-removal joint 28 to which the vacuum pressure retaining filter 29 is fixed is used as a member for maintaining a vacuum pressure (a vacuum pressure retaining mechanism). Alternatively, a check-valve, an electromagnetic valve, or a needle shaped component having a small hole might be used instead of the vacuum pressure retaining filter 29 for permitting a flow from the head side toward the atmosphere side.

Next, details of the area surrounding the head tip 26 which becomes a source for generating pressure for ejection will be explained. On the piezoelectric ceramic plate 1 constituting the piezoelectric ceramic plate head tip 26, a plurality of channels 5 are juxtaposed in parallel to be communicated with the nozzle holes 11 and each channel 5 is separated and isolated by sidewalls 21. One end section extending in the longitudinal direction of each channel 5 is arranged to come to one edge face of the piezoelectric ceramic plate 1, the other opposite end section does not reach the other edge face of the ceramic plate 1 and thus, the depth of each channel 5 becomes gradually shallower. Moreover, electrodes 4 for applying a driving electric field are formed along the longitudinal direction of the open sides of the channel 5 at the sidewalls 21 on both sides in the width direction of each channel 5.

Respective channels 5 formed in the piezoelectric ceramic plate 1, for instance, are formed by using a disc-like die cutter and the part where the depth becomes gradually shallower is formed according to the shape of the die cutter. Moreover, the electrodes 4 formed in respective channels 5 are formed by, for example, evaporation from a well-known angle of inclination. One end of the flexible board 19 is connected to the electrodes 4 provided on the open sides of both sidewalls 21 of thusly formed channels 5, and the electrodes 4 are electrically connected to the driving circuit by connecting another end of the flexible board 19 to the driving circuit on the circuit board 14 which is not shown in the drawing figures.

Moreover, an ink chamber plate 2 is connected to the open side of the respective channels 5 of the piezoelectric ceramic plate 1. In the ink chamber plate 2, a common ink chamber 6 formed so as to pierce or extend through the plate 2 in its thickness direction is provided for covering all over the area of the juxtaposed channels 5.

The ink chamber plate 2 may be made of a ceramic plate and a metal plate and so on. However, when taking into consideration the deformation after joining with the piezoelectric ceramic plate 1, a ceramic plate which has a similar thermal expansion coefficient to that of the plate 1 is preferably employed.

A nozzle plate 3 is connected to the end face where the channels 5 open up from the composite body consisting of the piezoelectric ceramic plate 1 and the ink chamber plate 2, and nozzle holes 11 are formed at respective positions of the nozzle plate 3 facing the respective channels 5.

In this embodiment, the nozzle plate 3 is made larger than the area of the end face where the channels 5 open up from the composite body consisting of the piezoelectric ceramic plate 1 and the ink chamber plate 2. This nozzle plate 3 is one obtained by forming the nozzle holes 11 in a polyimide film by the use of, for example, an excimer laser device. Moreover, although it is not shown in the drawing figures, a water-repellant membrane having water-repellency is provided to coat the face of the nozzle plate 3 which confronts a printed target so as to prevent adhesion of ink.

Moreover, a head cap 12 holding the nozzle plate 3 is connected to the outer face of the end face side where each channel 5 opens up from the composite body formed by this piezoelectric ceramic plate 1 and the ink chamber plate 2. This head cap 12 is connected to the outside of the end face of the composite body of the nozzle plate 3 for stably holding the nozzle plate 3 in position.

In the head tip 26 having the described configuration, a face of the piezoelectric ceramic plate 1 opposite to the face thereof confronting the ink chamber plate 2 is securely connected to the base 13.

On the other hand, the flow-channel 9 is connected to one side of this ink chamber plate 2.

Herein, the structure of the flow-channel 9 and the internal structure of the flow-channel 9 in which ink actually flows will be explained in detail by referring to FIG. 1. In the flow-channel 9, an ink inlet port 22 is provided at the center and two bubble exhausting holes 8*a* and 8*b* are provided at both sides in the longitudinal direction facing upward to become a communication path with atmosphere, and they are connected, respectively, to the flow-channel joint 50 and the bubble returns 51*a* and 51*b* of the pressure relief unit 20. In fact, ink flows by using a system in which ink is supplied through the flow-channel joint 50 and the ink inlet port 22. In this embodiment, the ink inlet port 22 is provided at the center and bubble exhausting holes 8*a* and 8*b* are provided at both sides. However, there is no problem if an ink inlet port 22 is provided at one end in the longitudinal direction and a bubble exhausting hole is provided at the other end, that is, there is a purpose in providing bubble exhausting holes in opposition to the ink inlet port 22 at positions where bubbles easily remain, and the position and the number are not limited.

Moreover, in the flow-channel 9, a filter 7 is provided in the part which is facing the common ink chamber 6 extending in the juxtaposed direction of respective channels 5 as a filter element having holes with a diameter of 8 micrometers, for instance, to remove dust and other foreign material mixed in with the ink, and the ink reservoir A 10 located at the upstream side and the ink reservoir B 43 located at the downstream side are formed partitioning the inner wall of the flow-channel 9 by the filter 7.

Then, in the inkjet head 15 of this embodiment, for instance, ink coming from the ink tank fills up the ink reservoir 54 of the pressure relief unit 20 during the initial filling, and ink is introduced into the flow-channel 9 while passing through the flow-channel joint 50 and the ink inlet port 22. Since air bubbles 27*a* and 27*b* mixed in with the ink have a large resistance for passing through the filter 7, they remain in the ink reservoir A 10. Moreover, when the introduction of ink continues further, ink flows into the ink reservoir B 43 and the air bubbles 27*a* and 27*b* respectively are delivered to the bubble exhausting holes 8*a* and 8*b*. Ink passing through the ink reservoir B 43 passes inside of the head tip 26 and flows into the nozzle holes 11. Air bubbles 27*a* and 27*b* pass through the bubble exhausting holes 8*a* and 8*b* together with ink, pass through the bubble returns 51*a* and 51*b* and the bubble-removal channel 53, and then they are exhausted into the atmosphere together with ink through the tube 25, resulting in no air bubbles at all being present in the ink reservoir A 10. The path along which air bubbles flow from the ink flow-channel 9 through the tube 25 into the atmosphere constitutes an atmosphere-communication channel.

As explained above, in the inkjet head of this embodiment 15, air bubbles in the area of the ink reservoir A 10 are exhausted into the atmosphere together with ink passing through the bubble-removal joint 28 and the tube 25 after passing the bubble exhausting holes 8*a* and 8*b*, the bubble returns 51*a* and 51*b*, and the bubble-removal channel 53, so that air bubbles are certainly prevented from remaining in the ink reservoir A 10. Therefore, shortages in the supply of ink to the common ink chamber 6 and each channel 5 can be surely prevented, which would be caused by a reduction in the ink-storage capacity of the ink reservoir A 10, which reduction might be in turn caused by any residual bubbles.

Moreover, in this embodiment, since the bubble-removal joint 28 exhibits such a function that ink and bubbles are exhausted to the atmosphere during cleaning by the apply of a pressure, and a vacuum pressure created in the ink routing channel connecting the ink tank 80 with the inkjet head 15 is maintained during the printing operation, an ordinary printing operation can be stably performed.

Thus, since the air bubbles can surely be prevented from being left in the ink reservoir A 10, any failure in printing operation and so on can be surely prevented.

Of course, according to the inkjet head 15 of this embodiment, even in the case where the amount of ink ejected per unit time is large and ink such as water based ink, etc. is used, where the permeation of air bubbles is worse, shortages in the supply of ink to both the common ink chamber 6 and each channel 5 can be surely prevented, and the ejection stability of ink and the reliability thereof can be improved.

The reason why air bubbles which did not pass through the filter 7 could pass the vacuum pressure retaining filter 29 is that the vacuum pressure retaining filter 29 has markedly larger holes than the filter 7 and has a smaller flow through resistance. However, the vacuum pressure retaining filter 29 can sufficiently keep roughly 50 mm $H_2O$ which is a vacuum pressure inside the ink routing channel created in the ink tank and the inkjet head 15 by the surface tension of ink when the mesh is filled with ink. Moreover, the vacuum pressure retaining filter 29 used in the present invention has a hole diameter of 25 micrometers, but it is not necessary to be limited to this embodiment, and there is no problem if an appropriate hole diameter is selected according to the respective purpose.

Figure 19:
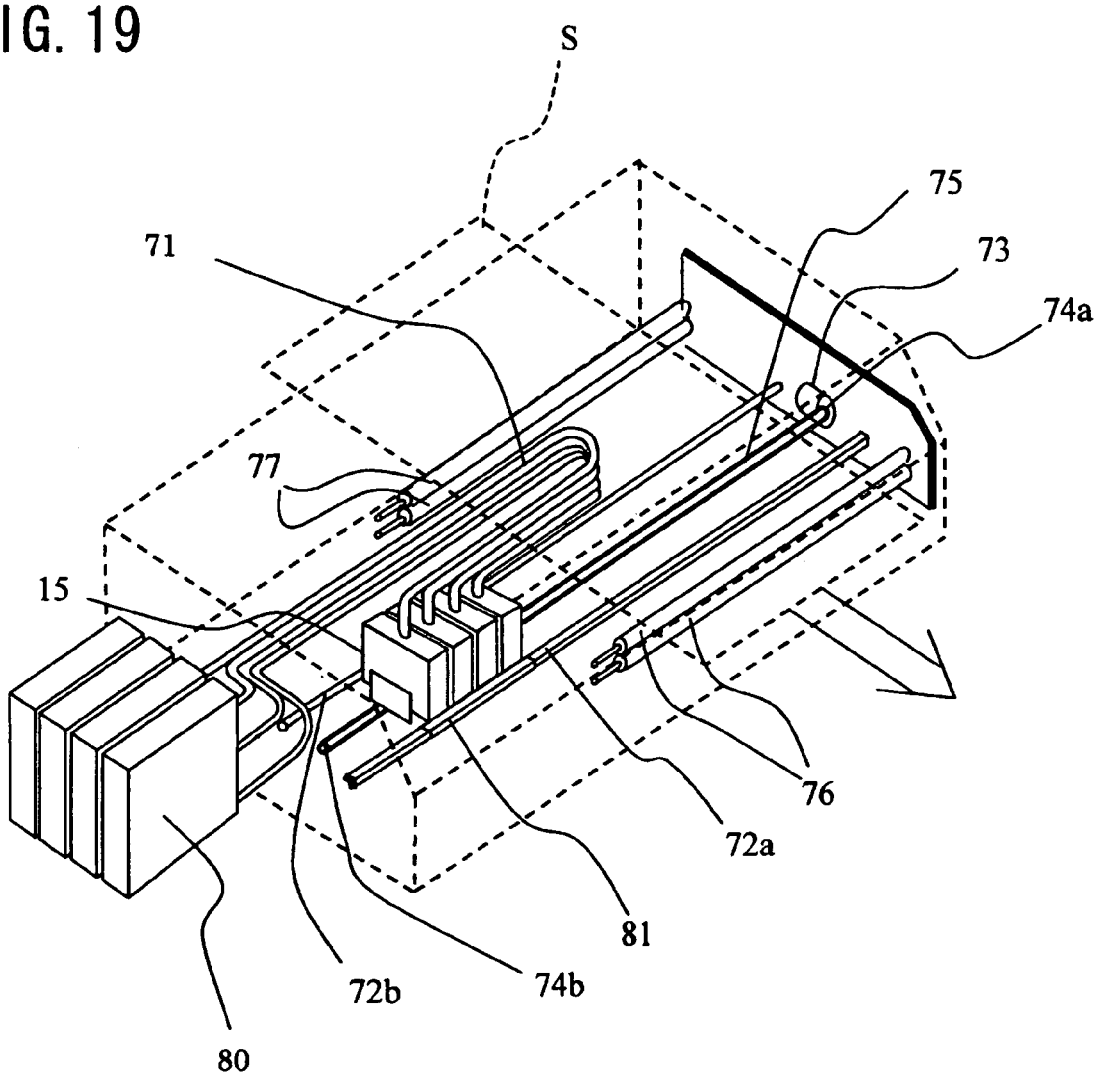
FIG. 19 is a perspective view, illustrating an inkjet head recording device of the present invention.

FIG. 19 is an inkjet recording device using an inkjet head of the present invention. The inkjet head 15 is mounted on a carriage 81 which is movable in the axial direction on a pair of guide-rails 72*a* and 72*b*, supplying ink from the ink cartridges 80 passing through ink tubes 71, is conveyed by a timing belt 75 which is suspended between a pulley 74*a* provided at one end of the guide-rails 72*a* and 72*b* and connected to a carriage driving motor 73 and a pulley 74*b* provided at the other end. At both sides in a direction perpendicular to the conveyance direction of the inkjet head 15, a pair of transfer rollers 76 and 77 is provided, respectively, along the guide-rails 72*a* and 72*b* (paper transfer mechanism). These transfer rollers 76 and 77 are for transferring a target recording or printing medium S underneath the inkjet head 15 in a direction perpendicular to the conveyance direction of the inkjet head 15 in question.

According to such an inkjet type recording device, characters and images can be recorded by printing on the target recording medium by transferring the target recording medium S and scanning the inkjet head 50 in a direction perpendicular to the transfer direction thereof.

SECOND EMBODIMENT

Figure 7:
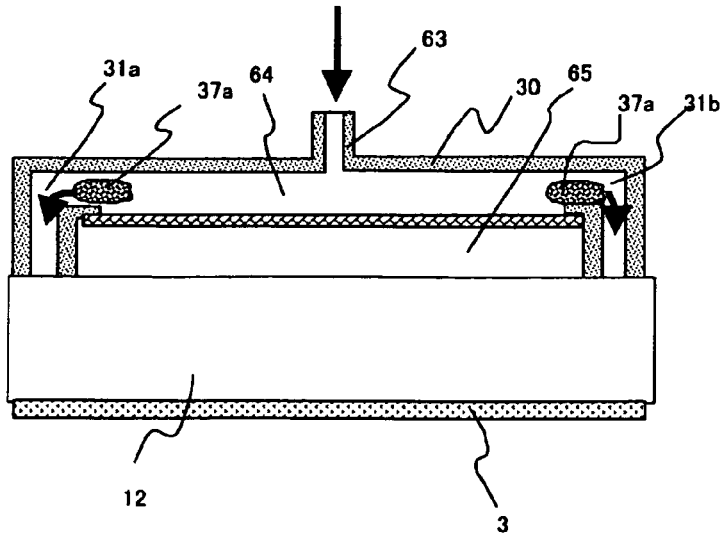
FIG. 7 is a schematic cross-sectional view, illustrating the main important portion of an inkjet head of the second embodiment of the present invention.
Figure 8:
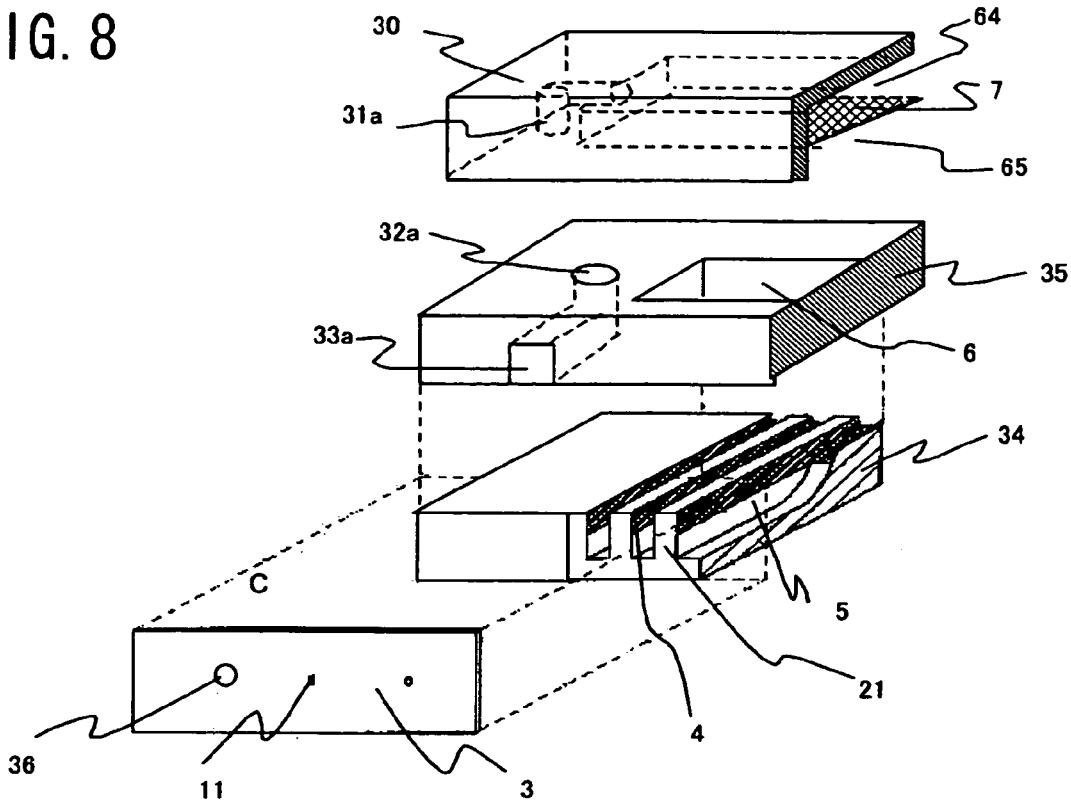
FIG. 8 is an exploded view, illustrating an area surrounding an ejection pressure generation section of an inkjet head of the second embodiment of the present invention.
Figure 9:
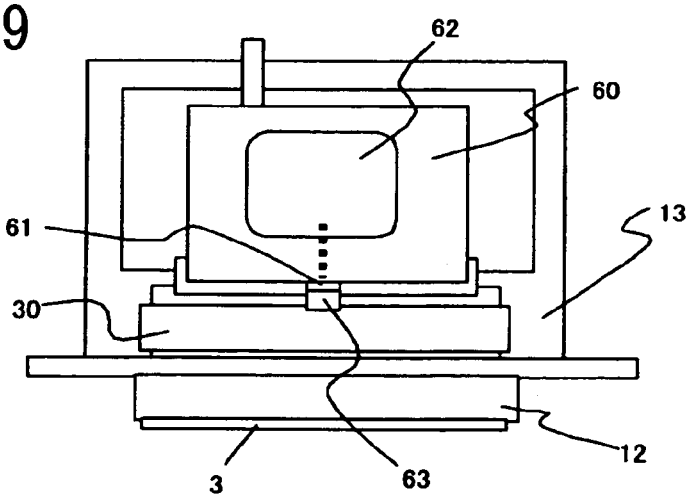
FIG. 9 is an elevational view, illustrating a whole inkjet head of the second embodiment of the present invention.
Figure 10:
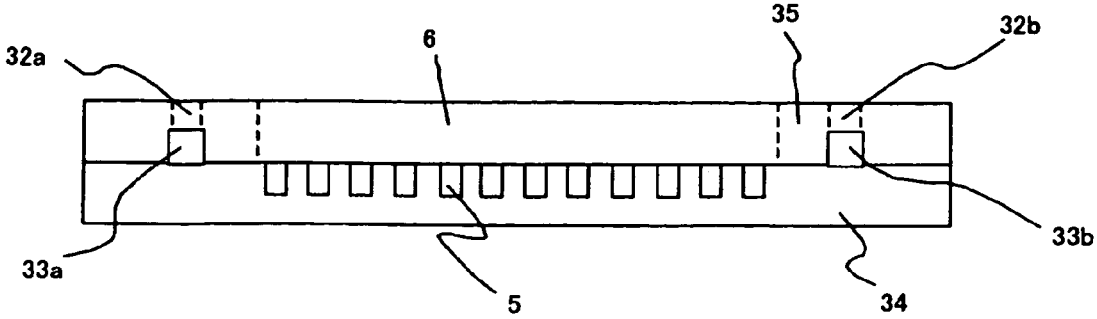
FIG. 10 is an elevational view, illustrating a head tip of an inkjet head of the second embodiment of the present invention.
Figure 11:
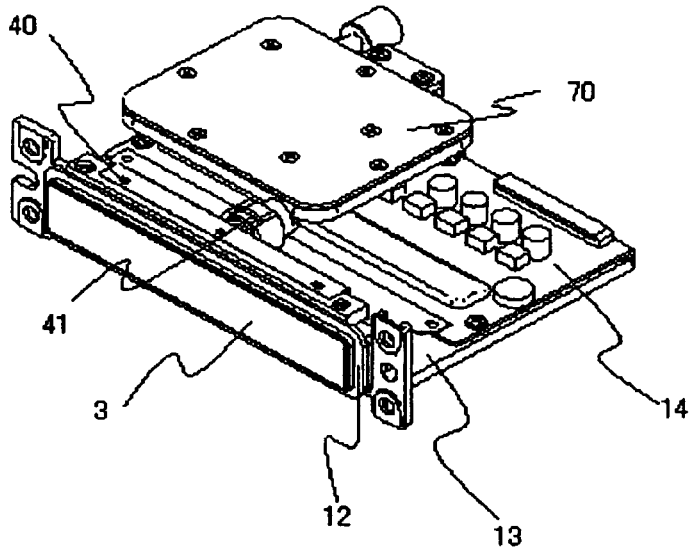
FIG. 11 PRIOR ART
FIG. 11 is a perspective view, illustrating a conventional inkjet head.
Figure 12:
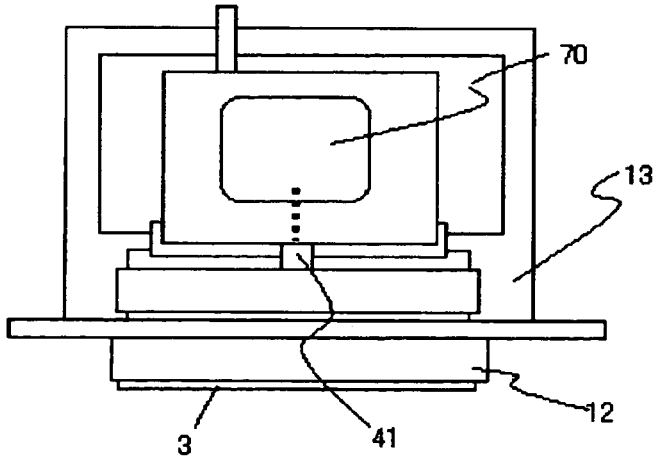
FIG. 12 PRIOR ART
FIG. 12 is an elevational view, illustrating a conventional inkjet head.
Figure 13:
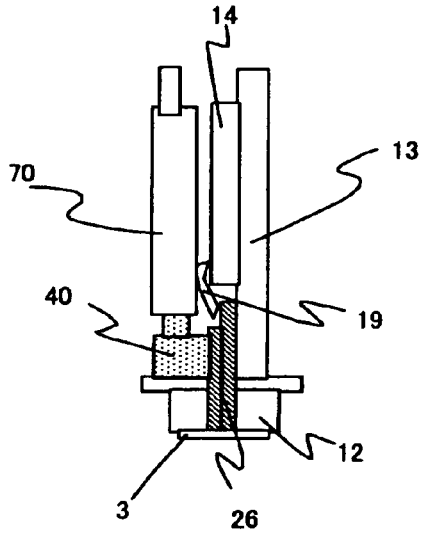
FIG. 13 PRIOR ART
FIG. 13 is a schematic cross-sectional view, illustrating a whole conventional inkjet head.
Figure 14:
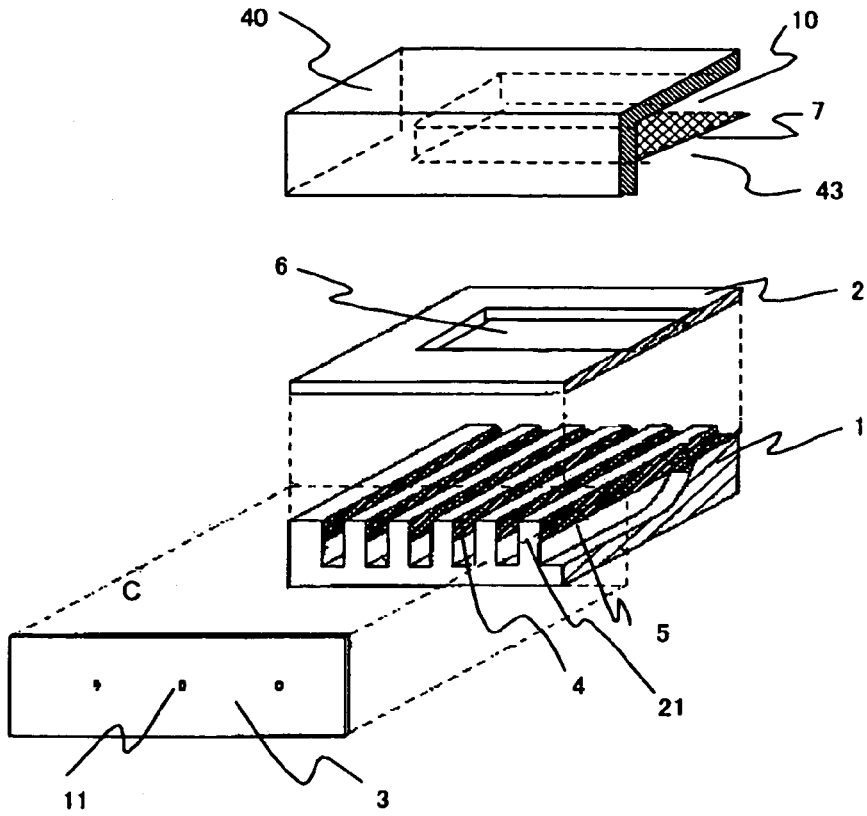
FIG. 14 PRIOR ART
FIG. 14 is an exploded view, illustrating an area surrounding an ejection pressure generation section of a conventional inkjet head.
Figure 15:
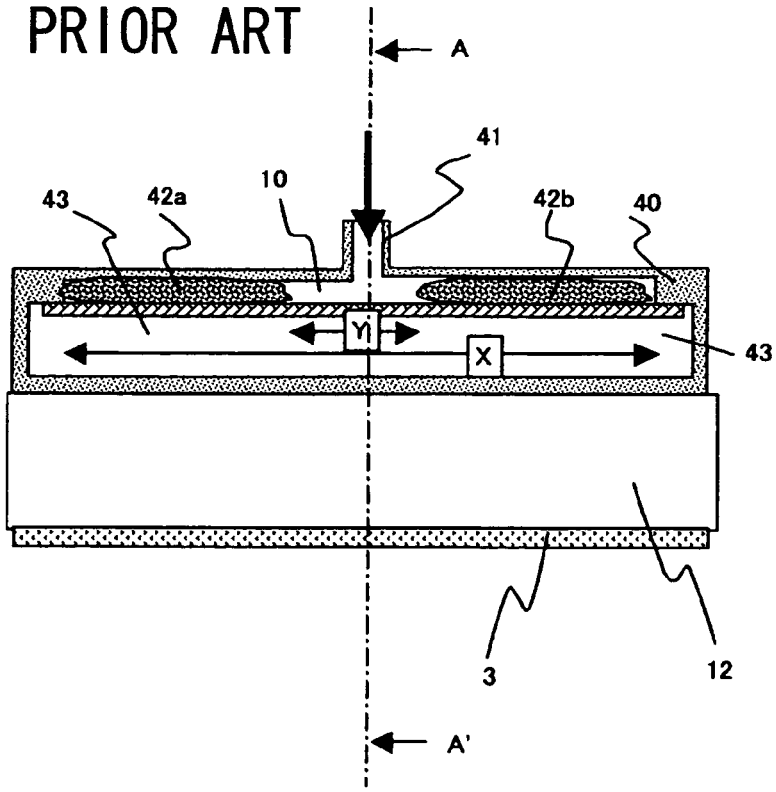
FIG. 15 PRIOR ART
FIG. 15 is a schematic cross-sectional view, illustrating the main parts of a conventional inkjet head.
Figure 16:
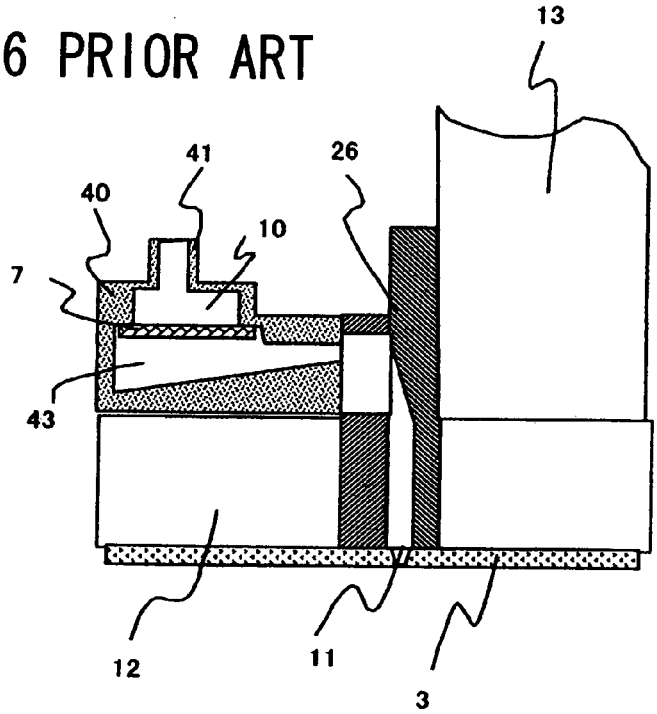
FIG. 16 PRIOR ART
FIG. 16 is a cross-sectional view of the conventional inkjet head when viewing from the arrows A-A' indicated in FIG. 15.

FIG. 7 is a schematic cross-sectional view of the main parts of an inkjet head according to the second embodiment, and FIG. 8 is an exploded view, illustrating an area surrounding the ejection pressure generation section of an inkjet head of the second embodiment. FIG. 9 is an elevation view, illustrating a whole inkjet head of the second embodiment, and FIG. 10 is an elevation view illustrating a head tip of the second embodiment.

As shown in the drawing figures, an inkjet head 15 of the second embodiment has a head tip 26, a flow-channel 30 which is provided on one face side thereof, a circuit board 14 on which a driving circuit, etc. is mounted to drive the head tip 26, and a pressure relaxation unit 60 to relieve the pressure change in the head tip 26, and each of these components is fixed on the base 13. In this pressure relaxation unit 60, a deformable film connected to the pressure relaxation unit 60 body to form a concave shaped ink reservoir and a flow-channel joint 61 to transfer ink collected in this ink reservoir to the flow-channel 30 are provided (FIG. 9).

Next, the details of the area surrounding the head tip 26 to be a pressure source for ejection will be explained. On the piezoelectric ceramic plate 34 constituting the head tip 26 a plurality of channels 5 are lined up in parallel to communicate with the nozzle holes 11, and each channel 5 is separated by the sidewalls 21. One end section along the longitudinal direction of each channel 5 is provided at one edge face of the piezoelectric ceramic plate 34, the other end section of the channel is not reaching the other edge face of the plate, and the depth of the channel becomes gradually shallower. Moreover, electrodes 4 for applying a driving electric field are formed along the longitudinal direction of the open sides of the channels 5 at the sidewalls 21 of both sides along the width direction of respective channels 5.

Each channel 5 formed on the piezoelectric ceramic plate 34 is formed by using a disc-like die cutter and the part where the depth becomes gradually shallower is formed according to the shape of the die cutter. Moreover, the electrodes 4 formed in respective channels 5 are formed by, for example, evaporation from a well-known angle of inclination. One end of the flexible board 19 is connected to the electrodes 4 provided on the open sides of both sidewalls 21 of such a channel 5, and the electrodes 4 are electrically connected to the driving circuit by connecting the other end of the flexible board 19 to the driving circuit on the circuit board 14 which is not shown in the drawing figures.

Moreover, an ink chamber plate 35 is connected to the open side of the channels of the piezoelectric ceramic plate 34. In the ink chamber plate 35, a common ink chamber 6 formed passing through the thickness direction is provided covering the whole area of the juxtaposed channels 5 and, in addition, air bubble holes 32*a* and 32*b* which are separated by the common ink chamber 6 are provided and slits 33*a* and 33*b* are formed to exhaust air bubbles at the bubble holes 32*a* and 32*b*.

Although the ink chamber plate 35 can be made of a ceramic plate and a metal plate and so on, a ceramic plate which has a similar thermal expansion coefficient to that of the piezoelectric plate 34 is preferably used by considering the deformation after joining with the piezoelectric ceramic plate 34.

A nozzle plate 3 is connected to the end face where the channels 5 open up from the composite body formed with the piezoelectric ceramic plate 34 and the ink chamber plate 35, and nozzle holes 11 are formed at positions of the nozzle plate 3 facing respective channels 5.

This nozzle plate 3 is one in which the nozzle holes 11 are formed in a polyimide film by using, for instance, an excimer laser device. Moreover, although it is not shown in drawing figures, a water-repellant film having water-repellency is provided at the face of the nozzle plate 3 which is facing a target of printing operation, in order to prevent adhesion of ink.

Moreover, the head cap 12 holding the nozzle plate 3 is connected to the outer face of the end face side where each channel 5 opens up from the composite body formed by this piezoelectric ceramic plate 34 and the ink chamber plate 35. This head cap 12 is connected to the outside of the end face of the composite body of the nozzle plate 3 for stably holding the nozzle plate 3.

In the head tip 26 having the described configuration, a face which is on the opposite side of the ink chamber plate 35 of the piezoelectric ceramic plate 34 is connected and fixed to the base 13. On the other hand, the flow-channel 30 is connected to one side of this ink chamber plate 35.

Herein, the structure of the flow-channel 30 (ink flow-channel) and the internal structure of the flow-channel 30 in which ink actually flows will be explained in detail. In the flow-channel 30, an ink inlet port 63 is provided at the center and actual ink flows using a system for supplying ink through the flow-channel joint 61 and the ink inlet port 63.

Moreover, in the flow-channel 30, the filter 7 (a filter element) having holes with a diameter of 8 micrometers is provided at the part which is facing the common ink chamber 6 extending in the juxtaposing direction of respective channels 5, for instance, to remove dust and foreign material mixed in with the ink, and the ink reservoir A 64 located at the upstream side and the ink reservoir B 65 located at the downstream side are formed partitioning the inner wall of the flow-channel 30 by the filter 7. Flow-channel openings 31*a* and 31*b* are formed on both sides of the ink reservoir A 64 and these flow-channel openings 31*a* and 31*b* are located at the positions communicating with the bubble holes 32*a* and 32*b*, respectively, which are provided on the aforementioned ink chamber plate 35. That is, the flow-channel openings 31*a* and 31*b* formed on both sides of the ink reservoir A 64 are connected to a fine hole 36 with a diameter of 0.1 mm, which opens to the same surface as the nozzle holes 11 formed in the nozzle plate 3, through the bubble holes 32*a* and 32*b* and slits 33*a* and 33*b* and form a channel communicating with the atmosphere. This fine hole 36 also has the function to maintain a vacuum pressure in the ink flow-channel, and the size has to be decided so as to be an appropriate size for use in an inkjet head 15. Moreover, in this embodiment, the slits 33*a* and 33*b* are formed in the ink chamber plate 35, however, a slit may be formed in the piezoelectric ceramic plate 34, and there is no problem if another component having a flow through channel is connected to the fine hole 36 and not through the piezoelectric ceramic plate 34 and the ink chamber plate 35. In this embodiment, flow-channel openings 31*a* and 31*b* are provided at both ends relative to the ink inlet port 63 located at the center of the flow-channel 30, however, there is no problem if an ink inlet hole is provided at one end of the flow-channel 30 and a flow-channel opening is provided at another end, and the position and number are not limited.

Then, in the inkjet head 15 of this embodiment, for instance, ink coming from the ink tank (not shown in the figure) fills up the ink reservoir 62 of the pressure relief unit 60 during the initial filling, and ink is introduced into the flow-channel 30 passing through the flow-channel joint 61 and the ink inlet port 63. Since bubbles 37*a* and 37*b* mixed in with the ink have a large resistance for passing through the filter 7, they remain in the ink reservoir A 64. Moreover, when the introduction of ink further continues, ink flows into the ink reservoir B 65 and air bubbles 37*a* and 37*b* respectively move to the flow-channel openings 31*a* and 31B. Ink passing through the ink reservoir B 65 passes inside of the head tip 26 and flows into the nozzle holes 11. Air bubbles 37*a* and 37*b* together with ink pass through the flow-channel openings 31*a* and 31*b* and pass the bubble holes 32*a* and 32*b* and the slits 33*a* and 33*b*, and then they are exhausted into the atmosphere together with ink, resulting in no air bubbles at all existing in the ink reservoir A 64.

As explained above, in the inkjet head 15 of this embodiment, air bubbles in the area of the ink reservoir A 64 are exhausted together with ink into the atmosphere, passing through the flow-channel openings 31*a* and 31*b*, the bubble holes 32*a* and 32*b*, the slits 33*a* and 33*b*, and fine hole 36, so that air bubbles can be prevented with certainty from being left in the ink reservoir A 64. The path along which air bubbles flow from the ink flow-channel 30 through the fine hole 36 into the atmosphere constitutes an atmosphere-communication channel. Therefore, shortages in the supply of ink to the common ink chamber 6 and each channel 5 can be surely prevented, which would otherwise be caused by a change in the storage capacity of the ink reservoir A 64 due to the presence remaining of air bubbles.

Moreover, in this embodiment, since there is a function where the ink and the bubbles are exhausted into the atmosphere during cleaning by vacuuming and presurizing and since a vacuum pressure created in the ink flow-channel connecting the ink tank 80 with the inkjet head 15 is maintained by a meniscus formed by the fine hole 36 during the printing operation, an ordinary printing operation can be stably performed.

In this embodiment, since the fine hole 36 is formed on the same surface as the nozzle plate 3, an inkjet can be made smaller and a lower cost can be achieved.

Thus, since the bubbles can surely be prevented from staying in the ink reservoir A 64, printing problems, etc. can surely be prevented.

Of course, according to the inkjet head of this embodiment, even in the case when the amount of ink ejected per unit time is large and ink such as water based ink, etc. is used, where the permeation of bubbles is worse, shortages in the supply of ink to the common ink chamber 6 and to each of the channels 5 can be surely prevented, and the ejection stability of ink and the reliability can be improved.

What is claimed is:

1. An inkjet head comprising:

a plurality of channels in communication with respective nozzles;

an ink chamber that supplies ink to each of the channels;

an ink flow-channel in communication with the ink chamber;

a filter element provided in the ink flow-channel;

an atmosphere-communication channel having one end in communication with the ink flow-channel at a location upstream of the filter element and another end in communication with the atmosphere; and a vacuum pressure retaining system that is provided in the atmosphere-communication channel and that maintains a vacuum pressure prevailing in the ink flow-channel so that air bubbles in the ink flow-channel are discharged to the atmosphere through the atmosphere-communication channel and the vacuum pressure retaining system.

2. An inkjet head according to claim 1; wherein the filter element comprises a first mesh filter.

3. An inkjet head according to claim 2; wherein the vacuum pressure retaining system is comprised of a second mesh filter having a smaller passing resistance per unit area than the first mesh filter.

4. An inkjet head according to claim 1; wherein the atmosphere-communication channel comprises a plurality of channels in communication with the atmosphere.

5. An inkjet head according to claim 1; wherein the vacuum pressure retaining system is comprised of an electromagnetic valve.

6. An inkjet head according to claim 1; wherein the vacuum pressure retaining system is comprised of a check-valve.

7. An inkjet head according to claim 1; wherein the vacuum pressure retaining system is comprised of a needle-shaped component.

8. An inkjet head according to claim 1; wherein the atmosphere-communication channel is formed in a pressure relief unit provided in the vicinity of the head.

9. An inkjet head according to claim 1; wherein the other end of the atmosphere-communication channel and the nozzles open to the same surface.

10. An inkjet head according to claim 9; wherein the atmosphere-communication channel passes through a part that configures the channels.

11. An inkjet head according to claim 9; wherein the atmosphere-communication channel passes through a part that configures the ink chamber.

12. An inkjet recording device comprising:

a paper transferring system and an inkjet head according to claim 1.

13. An inkjet head comprising:

a plurality of channels communicating at one end thereof with respective nozzle openings;

an ink chamber communicating with the channels for supplying ink to the channels;

an ink flow channel having an inlet port for receiving ink and communicating with the ink chamber for delivering ink to the ink chamber;

a filter disposed in the ink flow channel;

an atmosphere-communication channel having one end connected to the ink flow channel at a location upstream of the filter and another end communicating with the atmosphere; and a vacuum pressure retaining unit disposed in the atmosphere-communication channel to maintain a vacuum pressure in the ink flow channel so that air bubbles present in the ink flow channel are discharged to the atmosphere through the atmosphere-communication channel and the vacuum pressure retaining unit.

14. An inkjet head according to claim 13; wherein the atmosphere-communication channel comprises a plurality of channels each having one end connected to the ink flow channel at a location upstream of the filter and another end communicating with the atmosphere via the vacuum pressure retaining unit.

15. An inkjet head according to claim 13; wherein the nozzle openings are formed in a plate member disposed at the one ends of the channels, the nozzle openings and the other end of the atmosphere-communication channel all terminating and opening at the same surface of the plate member.

16. An inkjet head according to claim 15; wherein the vacuum pressure retaining unit comprises a hole formed in the plate member, the hole constituting the other end of the atmosphere-communication channel and having a size effective to maintain a vacuum pressure in the ink flow channel.

17. An inkjet head according to claim 13; wherein the filter comprises a first mesh filter, and the vacuum pressure retaining unit comprises a second mesh filter having a smaller flow-through resistance per unit area than the first mesh filter.

18. An inkjet head according to claim 13; wherein the vacuum pressure retaining unit comprises an electromagnetic valve.

19. An inkjet head according to claim 13; wherein the vacuum pressure retaining unit comprises a check valve.

20. An inkjet head according to claim 13; wherein the vacuum pressure retaining unit comprises a needle-shaped component.

* * * * *

UNITED STATES PATENT AND TRADEMARK OFFICE

CERTIFICATE OF CORRECTION

PATENT NO. : 7,604,337 B2
APPLICATION NO. : 11/388372
DATED : October 20, 2009
INVENTOR(S) : Osamu Koseki It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 401 days.

Signed and Sealed this

Fifth Day of October, 2010

David J. Kappos

David J. Kappos
*Director of the United States Patent and Trademark Office*